US009302504B2

(12) United States Patent
Sasaki

(10) Patent No.: US 9,302,504 B2
(45) Date of Patent: Apr. 5, 2016

(54) RECORDING APPARATUS WITH MEDIUM SUPPORT SECTION FOR PASSING VAPOR

(71) Applicant: SEIKO EPSON CORPORATION, Tokyo (JP)

(72) Inventor: Tsuneyuki Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/450,755

(22) Filed: Aug. 4, 2014

(65) Prior Publication Data

US 2015/0035920 A1 Feb. 5, 2015

(30) Foreign Application Priority Data

Aug. 5, 2013 (JP) ..... 2013-162063

(51) Int. Cl.
*B41J 2/01* (2006.01)
*B41J 11/00* (2006.01)
*B41J 11/06* (2006.01)

(52) U.S. Cl.
CPC ..... *B41J 11/002* (2013.01); *B41J 11/06* (2013.01)

(58) Field of Classification Search
CPC ..... B41J 11/002; B41J 11/06
USPC ..... 347/102, 101, 16
See application file for complete search history.

(56) References Cited

U.S. PATENT DOCUMENTS

| | | | | |
|---|---|---|---|---|
| 6,270,074 | B1 * | 8/2001 | Rasmussen et al. | 271/276 |
| 8,292,419 | B2 | 10/2012 | Hori | |
| 2013/0328963 | A1 | 12/2013 | Domae | |
| 2014/0049590 | A1 * | 2/2014 | Tateishi et al. | 347/104 |

FOREIGN PATENT DOCUMENTS

| | | |
|---|---|---|
| JP | 01-288450 | 11/1989 |
| JP | 2000-075773 | 3/2000 |
| JP | 2009-285877 | 12/2009 |
| JP | 2012-179802 | 9/2012 |

* cited by examiner

*Primary Examiner* — Henok Legesse
(74) *Attorney, Agent, or Firm* — Workman Nydegger

(57) ABSTRACT

A recording apparatus includes: a head that is capable of ejecting liquid on a medium; a heater that dries the liquid ejected on the medium; a medium support section that is provided with a first opening section through which vapor which is evaporated from the liquid ejected on the medium passes; a first member that is provided with a second opening section through which the vapor passing through the first opening section passes and allows at least some of the vapor to be condensed; and a second member that allows the vapor passing through the second opening section to be condensed.

5 Claims, 5 Drawing Sheets

RECORDING APPARATUS WITH MEDIUM SUPPORT SECTION FOR PASSING VAPOR

The entire disclosure of Japanese Patent Application No. 2013-162063, filed Aug. 5, 2013 is expressly incorporated reference herein.

BACKGROUND

1. Technical Field

The present invention relates to a recording apparatus and, particularly, to a recording apparatus including a heater for drying liquid ejected on a medium.

2. Related Art

In related art, a recording apparatus including a heater for drying liquid recorded on a medium is known.

For example, an ink jet printer capable of drying ink recorded on a medium by a heater is disclosed in JP-A-2012-179802.

However, in the ink jet printer capable of drying the ink recorded on the medium by the heater disclosed in JP-A-2012-179802, there is a problem that vapor evaporated from the ink by the heater flows into a side of a medium support section and the vapor is condensed in the medium support section. If the vapor is condensed in the medium support section, condensed components are attached to the medium that is supported on the medium support section and deterioration of quality of an image that is recorded or deterioration of quality of the medium itself is caused.

SUMMARY

The invention can be realized in the following forms or application examples.

Application Example 1

According to this application example, there is provided a recording apparatus including: a head that is capable of ejecting liquid on a medium; a heater that dries the liquid ejected on the medium; a medium support section that is provided with a first opening section through which vapor which is evaporated from the liquid ejected on the medium passes; a first member that is provided with a second opening section through which the vapor passing through the first opening section passes and allows at least some of the vapor to be condensed; and a second member that allows the vapor passing through the second opening section to be condensed.

In this case, when drying the liquid ejected on the medium by the head using the heater, the vapor evaporated from the liquid ejected on the medium flows to the first member through the first opening section provided in the medium support section, some of the vapor is condensed in the first member, remaining vapor that is not condensed in the first member flows to the second member through the second opening section provided in the first member, and the remaining vapor is condensed in the second member. Thus, the vapor flows to the first member and the second member before the vapor is condensed in the medium support section and it is possible to condense the vapor in the first member and the second member. That is, in the recording apparatus including the heater for drying the liquid ejected on the medium, it is possible to suppress the condensation of the vapor in the medium support section, which is evaporated from the liquid by the heater.

As the member for condensing the vapor, the configuration including a plurality of members such as the first member and the second member is particularly useful for a case where an amount of the vapor is large or concentration of the vapor is high. Even if all vapors are not condensed in the first member, it is possible to condense the remaining vapor in the second member. That is, it is possible to suppress the condensation of the vapor in the medium support section by providing the plurality of members as the member for condensing the vapor, even in a case where the amount of the vapor is large or the concentration of the vapor is high.

Application Example 2

In the recording apparatus according to the application example, it is preferable that a ratio of total area of the second opening section to an area of the first member be 10% or more and 60% or less.

In this case, a balance is appropriately maintained between some of the vapor being condensed in the first member and some of the vapor passing through the first member, and a synergistic effect develops due to combination of the first member and the second member. Therefore, it is possible to effectively suppress the condensation of the vapor in the medium support section.

Application Example 3

In the recording apparatus according to the application example, it is preferable that the first member be provided with a plurality of second opening sections.

In this case, it is possible to disperse the second opening sections in a plurality of positions in the first member. Thus, unevenness in a condensation suppression effect with respect to the medium support section is decreased and it is possible to effectively suppress the condensation of the vapor in the medium support section.

Application Example 4

In the recording apparatus according to the application example, it is preferable that if a distance between centroids of the second opening sections in a transportation direction in which the medium is transported is y and a distance between centroids of the second opening sections in an intersecting direction intersecting the transportation direction is x, the plurality of second opening sections be provided so as to satisfy $2\times$(area of one second opening section)$\leq x\times y\leq 5\times$(area of one second opening section).

In this case, it is possible to disperse the arrangement positions of the plurality of second opening sections while appropriately maintaining the balance between some of the vapor being condensed in the first member and some of the vapor passing through the first member. Thus, the unevenness in the condensation suppression effect with respect to the medium support section is decreased while drawing out the synergistic effect by the combination of the first member and the second member. Therefore, it is possible to effectively suppress the condensation of the vapor in the medium support section.

BRIEF DESCRIPTION OF THE DRAWINGS

The invention will be described with reference to the accompanying drawings, wherein like numbers reference like elements.

FIG. 5A is a schematic plan view illustrating a first member in a recording apparatus according to Modification Example 1 and FIG. 5B is a schematic plan view illustrating a first member in a recording apparatus according to Modification Example 2.

DESCRIPTION OF EXEMPLARY EMBODIMENTS

Figure 1:
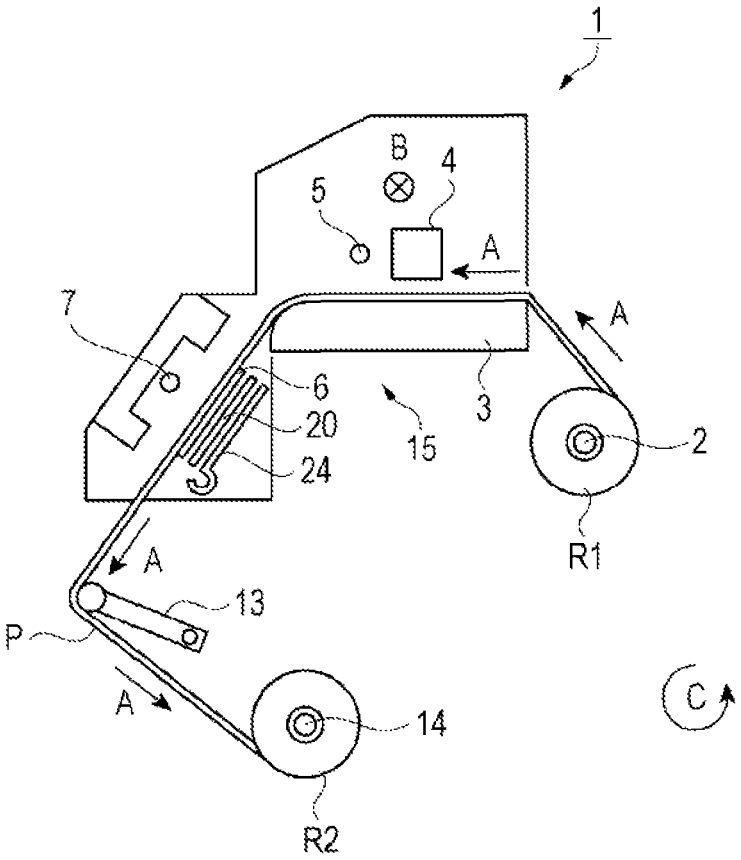
FIG. 1 is a schematic side view illustrating a recording apparatus according to a first embodiment.

Hereinafter, an embodiment of the invention will be described with reference to the drawings. Since a size of each member or the like is of a recognizable degree in the drawings below, a scale of each member or the like is different from an actual scale.

First Embodiment

First, a recording apparatus according to a first embodiment is described. The recording apparatus is a recording apparatus capable of recording an image on a medium by ejecting liquid on the medium. FIG. 1 is a schematic side view of a recording apparatus 1 according to the first embodiment.

The recording apparatus 1 of the embodiment includes a setting section 2 of a medium P capable of supplying a roll R1 of the medium P. Here, the medium P is a recording medium on which recording is performed by the recording apparatus 1. In the embodiment, a case where the medium P has a breathable property, liquid attached to a surface of the medium P is evaporated, and the evaporated vapor is transmitted to a back surface thereof is described as a main example. However, the medium P may have no breathable property and the evaporated vapor may go around to the back side of the medium P. When transporting the medium P in a transportation direction A, the setting section 2 rotates in a rotation direction C. Moreover, the rotation direction C is a counter-clockwise direction in FIG. 1. Moreover, a roll-type medium is used as the medium P, but it is possible to use a single sheet type medium.

Furthermore, the recording apparatus 1 includes a transportation mechanism 15 having a plurality of transportation rollers (not illustrated) to transport the medium P in the transportation direction A.

Furthermore, the recording apparatus 1 is movable in an intersecting direction B intersecting the transportation direction A of the medium P and includes a head 4 capable of ejecting the liquid on the medium P. Furthermore, a platen 3 is provided in a position facing the head 4. An image is formed (recorded) on the medium P being transported on the platen 3 by ejecting the liquid while moving the head 4 in the intersecting direction B. For example, the liquid that is capable of being ejected from the head 4 includes ink containing a functional material such as a coloring material and solvent. For example, the coloring material includes dyes and pigments.

Furthermore, the recording apparatus 1 is provided with an auxiliary heater 5 on the downstream side of the head 4 in the transportation direction A of the medium P. The auxiliary heater 5 may supplementarily dry the liquid ejected from the head 4 on the medium P. Here, terms that supplyementarily drying the liquid ejected from the head 4 on the medium P mean that drying the liquid to the extent that the image formed on the medium P is not broken. It is possible to further reliably dry the liquid by using two heaters of the auxiliary heater 5 and a heater 7. At this time, the liquid may not be completely dried by heating by the auxiliary heater 5. Thus, an output of the auxiliary heater 5 may be weaker than that of the heater 7. If the output of the auxiliary heater 5 is weaker than that of the heater 7, it is possible to reduce thermal damage affecting the head 4 or to obtain an energy saving effect. For example, it is possible to use an infrared heater provided in a position facing the platen 3 as the auxiliary heater 5. In the embodiment, the auxiliary heater 5 is provided on the downstream side of the head 4 in the transportation direction A of the medium P, but the auxiliary heater 5 is not limited to such a heater and a heater capable of heating the recording medium P from on the side of the platen 3 may be used. Moreover, if the auxiliary heater 5 is provided in addition to the heater 7, it is possible to classify the auxiliary heater 5 and the heater 7 as a first heater and a second heater, respectively.

The heater 7 is provided in a position on the downstream side of the head 4 in the transportation direction A. In the embodiment, the heater 7 is disposed on the downstream side of the auxiliary heater 5. Then, a medium support section 6 supporting the medium is provided in a position facing the heater 7. Then, if a direction extending from the heater 7 to the medium support section 6 is a first direction, a first member 20 that is positioned on the first direction side of the medium support section 6 and a second member 24 that is positioned on the first direction side of the first member 20 are provided. In other words, the medium support section 6 is provided in the position on the downstream side of the head 4 in the transportation direction A, the first member 20 is provided in a lower section with respect to the medium support section 6, and the second member 24 is provided in a lower section with respect to the first member 20.

The heater 7 may dry a target. The target is, for example, the medium P or the liquid ejected on the medium P. At this time, the heater 7 may dry the liquid ejected on the medium P. Furthermore, the heater 7 may dry the liquid ejected on the medium P from the side on which the liquid is ejected on the medium P. For example, as the heater 7, it is possible to use a heater irradiating infrared rays. However, a type, a shape, an installation site, or the like of the heater 7 is not specifically limited. For example, as the heater 7, it is possible to use a heater irradiating ultraviolet rays or a fan heater supplying heated air.

Furthermore, a tension adjustment section 13 for adjusting a tension of the medium P when winding the medium P is provided on the downstream side in the transportation direction A of the medium P. Then, a winding section 14 capable of winding the medium P is provided on the downstream side of the tension adjustment section 13 in the transportation direction A of the medium P. When winding the medium P, the winding section 14 rotates in the rotation direction C. When winding the medium P by the winding section 14, a roll R2 of the medium P is formed.

Figure 2:
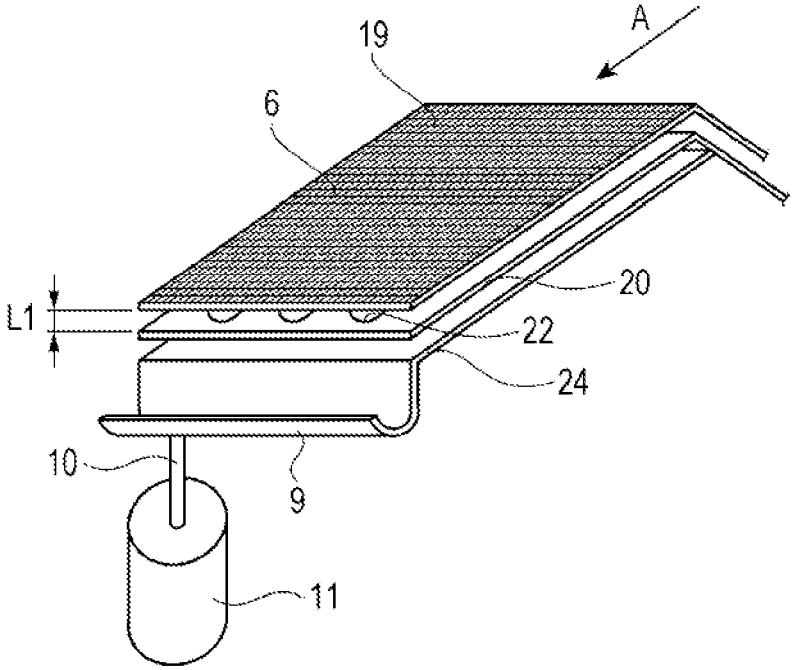
FIG. 2 is a schematic perspective view illustrating a medium support section, a first member, and a second member in the recording apparatus according to the first embodiment.

Next, the medium support section 6, the first member 20, and the second member 24 are described in detail. FIG. 2 is a schematic perspective view illustrating the medium support section 6 and the first member 20 in the recording apparatus 1 according to the first embodiment.

The medium support section 6 functions as a medium support section supporting the medium in a position facing the heater. The heater 7 is on the opposite side to the medium support section 6 across the medium P and heats a surface of the medium P on the opposite side to a surface that is supported. Thus, it is difficult to transfer the heat to the medium support section 6 and the medium support section 6 is likely to have a temperature lower than that of the surface on the opposite side to the surface of the medium P that is supported. Therefore, if surroundings of the medium support section 6 are wet, the vapor around the medium support section 6 is likely to be condensed. Thus, the medium support section 6 is provided with a first opening section 19. The first opening section 19 functions as an opening section through which the vapor evaporated from the liquid by the heater 7 passes. Moreover, if such a first opening section 19 is provided, the shape of the medium support section 6 is not specifically limited. In other words, the medium support section 6 is a medium support section in which the first opening section through which the vapor evaporated from the liquid ejected on the medium passes.

At this time, it is preferable that at least a part of the medium support section 6 be configured of a wire-shaped member. Furthermore, it is preferable that the medium support section 6 be configured in a mesh shape (net shape) by the wire-shaped members. Therefore, the vapor passes through the medium support section 6 while the medium support section 6 supports the medium. For example, as the wire-shaped member, fine wire-shaped metal such as a wire is used. Furthermore, the wire-shaped member may be a member other than that of metal. At this time, a portion of the mesh in the medium support section 6 corresponds to the first opening section 19.

At this time, it is preferable that at least a part of the medium support section 6 be configured of a wire-shaped member having a diameter of 0.3 mm or less. Therefore, it is possible to suppress the condensation of the vapor at a contact portion with the medium P in the medium support section 6 with high accuracy.

Table 1 represents evaluation results that are obtained by evaluating whether or not the vapor evaporated from the ink recorded on the medium P is condensed in the medium support section 6 when the diameter of the wire-shaped member is changed. A case where the condensation does not visually occur in the medium support section 6 is OK and a case where the condensation occurs in the medium support section 6 is NG.

TABLE 1

| Diameter of Wire-Shaped Member (mm) | Evaluation Result |
|---|---|
| 0.1 | OK |
| 0.2 | OK |
| 0.3 | OK |
| 0.4 | NG |
| 0.5 | NG |
| 0.6 | NG |
| 0.7 | NG |
| 0.8 | NG |
| 0.9 | NG |
| 1.0 | NG |

As represented in Table 1, a result of OK was obtained when the diameter of the wire-shaped member was 0.3 mm or less.

Furthermore, it is preferable that at least a part of the medium support section 6 be configured of the wire-shaped member having a diameter of 0.05 mm or more. As represented in Table 1, it is possible to suppress the condensation of the vapor at the contact portion with the medium P in the medium support section 6 with high accuracy as the diameter of wire-shaped member is fine, but if the diameter is too fine, a strength thereof has decreased and the wire-shaped member is likely to be cut. Specifically, when supporting a thick medium or a heavy medium, a load on the wire-shaped member is increased and the wire-shaped member is likely to be cut. When using the wire-shaped member having the diameter of 0.05 mm or more, the medium support section 6 is configured having a sufficient strength even when supporting a thick medium or a heavy medium.

Table 2 represents evaluation results that are obtained by evaluating whether or not the wire-shaped member is cut when supporting the medium when the diameter of the wire-shaped member is changed. A case where the wire-shaped member is not cut is OK and a case where the wire-shaped member is cut is NG.

TABLE 2

| Diameter of Wire-Shaped Member (mm) | Evaluation Result |
|---|---|
| 0.02 | NG |
| 0.03 | NG |
| 0.04 | NG |
| 0.05 | OK |
| 0.06 | OK |
| 0.07 | OK |

As represented in Table 2, a result of OK was obtained when the diameter of the wire-shaped member was 0.05 mm or more.

When considering the evaluation results represented in Table 1 and Table 2, it is preferable that the diameter of the wire-shaped member being used in the medium support section 6 be 0.05 mm or more and 0.3 mm or less. When using such a wire-shaped member, it is possible to support the thick medium or the heavy medium while suppressing the condensation in the medium support section 6.

Furthermore, it is preferable that an opening ratio in the medium support section 6 be 40% or more. Here, the opening ratio in the medium support section 6 represents that the medium support section 6 has some degree of opening section. That is, the opening ratio in the medium support section 6 is a ratio of total area of the first opening section 19 with respect to the area of the medium support section 6. If the opening ratio is 40% or more in the medium support section 6, the medium support section 6 has a high breathable property and it is possible to suppress the condensation of the vapor in the medium support section 6 with high accuracy.

Table 3 represents evaluation results that obtained by evaluating whether or not the vapor evaporated from the ink recorded on the medium P is condensed in the medium support section 6 when the opening ratio of the first opening section 19 with respect to the medium support section 6 is changed. A case where the condensation does not visually occur in the medium support section 6 is OK and a case where the condensation occurs in the medium support section 6 is NG.

TABLE 3

| Opening Ratio (%) | Evaluation Result |
|---|---|
| 10 | NG |
| 20 | NG |
| 30 | NG |
| 40 | OK |
| 50 | OK |
| 60 | OK |

TABLE 3-continued

| Opening Ratio (%) | Evaluation Result |
|---|---|
| 70 | OK |
| 80 | OK |
| 90 | OK |

As represented in Table 3, a result of OK was obtained when the opening ratio was 40% or more.

Furthermore, it is preferable that at least a part of the medium support section 6 be made of stainless steel. Since stainless steel is both inexpensive and sturdy, temperature conductivity and thermal conductivity thereof are low, and a contact angle with liquid droplets generated by condensing the vapor is large and is difficult to be wet, and it is possible to suppress the condensation of the vapor in the medium support section 6 with high accuracy. Moreover, the temperature conductivity is also referred to as thermal diffusivity, temperature diffusivity, or the like, and is obtained by dividing the thermal conductivity by the product of density and a specific heat capacity.

Furthermore, for the medium support section 6, it is possible to use a member that is made by subjecting metal (for example, steel or iron) other than stainless steel to nickel plating or chromium plating. Since in such a member, the temperature conductivity and the thermal conductivity thereof are also low, and the contact angle with liquid droplets generated by condensing the vapor is large and the member is difficult to be wet, it is possible to suppress the condensation of the vapor in the medium support section 6 with high accuracy.

If the direction extending from the heater 7 to the medium support section 6 is the first direction, the first member 20 is a member that is positioned on the first direction side of the medium support section 6. Furthermore, the first member 20 faces the medium support section 6 on the opposite side to a side on which the medium is supported in the medium support section 6. The first member 20 functions as a member for condensing the vapor passing through the first opening section 19. Furthermore, the first member 20 is provided with a second opening section 22. The second opening section 22 functions as an opening section through which the vapor passing through the first opening section 19 passes. That is, the first member 20 is configured such that some of the vapor passing through the first opening section 19 is condensed and some of the vapor passing through the first opening section 19 is capable of passing through the first member 20. In other words, the first member 20 is a first member that is provided with the second opening section through which the vapor passing through the first opening section passes and allows at least some of the vapor to be condensed. Moreover, the first member 20 is disposed at a distance from the medium support section 6 and the distance is referred to as L1.

The second member 24 is a member that is positioned on the first direction side of the first member 20. Furthermore, the second member 24 faces the first member 20 on the opposite side to the side facing the medium support section 6 in the first member 20. The second member 24 functions as a member for condensing the vapor passing through the second opening section 22. In other words, the second member 24 is a second member that allows the vapor passing through the second opening section to be condensed. The second member 24 is provided with a liquid receiver 9 in a lower section with respect thereto for receiving the liquid droplets generated by condensing the vapor. Furthermore, the liquid receiver 9 is provided with a waste liquid bottle 11 in a lower section with respect thereto for collecting the liquid stored in the liquid receiver 9 through a tube 10. As illustrated in FIG. 2, the second member 24 is configured so as to connect to the first member 20 at one end thereof in the transportation direction A. However, it may not be such a configuration, as long as the medium support section 6, the first member 20, and the second member 24 are disposed having distances therebetween.

Figure 3:
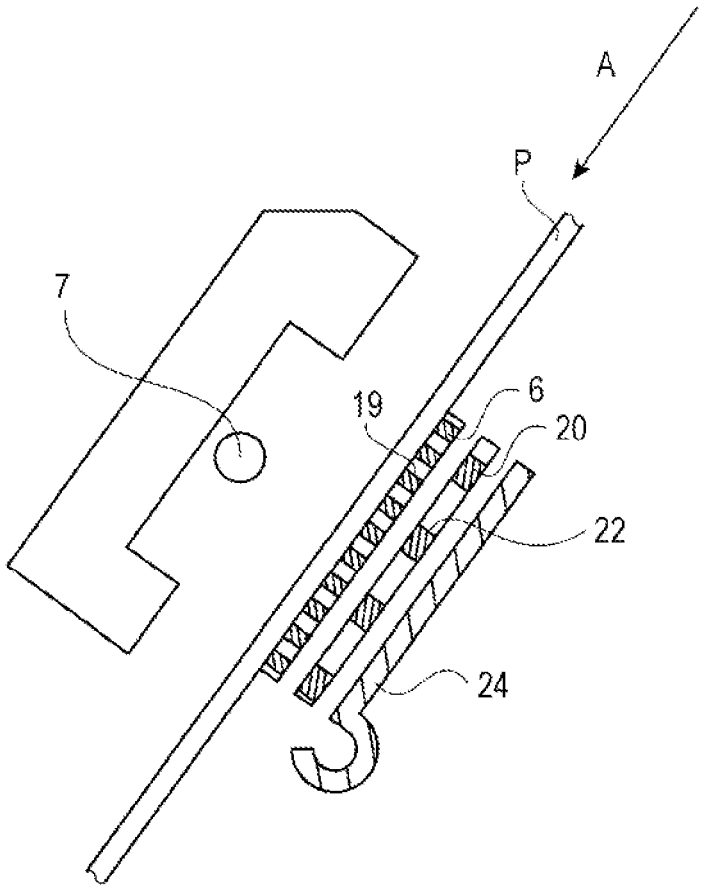
FIG. 3 is a schematic cross-sectional view illustrating the medium support section, the first member, and the second member in the recording apparatus according to the first embodiment.

FIG. 3 is a schematic cross-sectional view illustrating the medium support section 6, the first member 20, and the second member 24 in the recording apparatus 1 according to the first embodiment. According to the configuration, when drying the liquid ejected on the medium P by the head 4 with the heater 7, the vapor evaporated from the liquid ejected on the medium P flows to the first member 20 through the first opening section 19 provided in the medium support section 6 and some of the vapor is condensed in the first member 20. Thereafter, remaining vapor that is not condensed in the first member 20 flows to the second member 24 through the second opening section 22 provided in the first member 20 and the remaining vapor is condensed in the second member 24. Thus, it is possible to condense the vapor in the first member 20 and the second member 24 by flowing of the vapor to the first member 20 and the second member 24 before the vapor is condensed in the medium support section 6. That is, in the recording apparatus including the heater for drying the liquid that is recorded on the medium by ejecting the liquid on the medium, it is possible to suppress the condensation of the vapor evaporated from the liquid by the heater in the medium support section.

Specifically, the configuration including a plurality of members such as the first member 20 and the second member 24 as the members for condensing the vapor is effective for a case where the amount of the vapor is large or the concentration of the vapor is high. Even if all vapors are not condensed in the first member 20, it is possible to condense the remaining vapor in the second member 24. That is, it is possible to suppress the condensation of the vapor in the medium support section 6 by providing a plurality of members as the members for condensing the vapor, even in a case where the amount of the vapor is large or the concentration of the vapor is high.

Furthermore, it is preferable that the opening ratio in the first member 20 be 10% or more and 60% or less. Here, the opening ratio in the first member 20 represents that the first member 20 has some degree of opening section. That is, the opening ratio in the first member 20 is a ratio of total area of the second opening section 22 to the area of the first member 20.

A flowing effect of the vapor in the first member 20 increases as the opening ratio in the first member 20 decreases. Meanwhile, the flowing effect of the vapor in the second member 24 increases as the opening ratio in the first member 20 increases. The case where the first member 20 and the second member 24 are provided was effective for suppressing the condensation in the medium support section 6, and the opening ratio in the first member 20 was configured to be 10% or more and 60% or less. If the opening ratio is less than 10%, the vapor flowing to the second member 24 is too small and it is not possible to sufficiently exert the effect of the second member 24. That is, it becomes similar to a state where the member for condensing the vapor is only the first member. Furthermore, if the opening ratio is greater than 60%, the area of the non-opening section is too small in the first member 20 and it is not possible to sufficiently exert the effect of the first member 20. That is, it becomes similar to a state where the member for condensing the vapor is only the second member. On the contrary, if the opening ratio in the first member 20 is 10% or more and 60% or less, a balance is appropriately maintained between some of the vapor being condensed in the first member 20 and some of the vapor passing through the first member 20, and a synergistic effect develops due to combination of the first member 20 and the second member 24. Therefore, it is possible to effectively suppress the condensation of the vapor in the medium support section 6.

Table 4 represents evaluation results that are obtained by evaluating whether or not the vapor evaporated from the ink recorded on the medium P is condensed in the medium support section 6 when the opening ratio of the first member 20 is changed. A case where the condensation does not visually occur in the medium support section 6 is OK and a case where the condensation occurs in the medium support section 6 is NG.

TABLE 4

| Opening Ratio (%) | Evaluation Result |
|---|---|
| 0 | NG |
| 10 | OK |
| 20 | OK |
| 30 | OK |
| 40 | OK |
| 50 | OK |
| 60 | OK |
| 70 | NG |
| 80 | NG |
| 90 | NG |

As represented in Table 4, a result of OK was obtained when the opening ratio was 10% or more and 60% or less.

Figure 4:
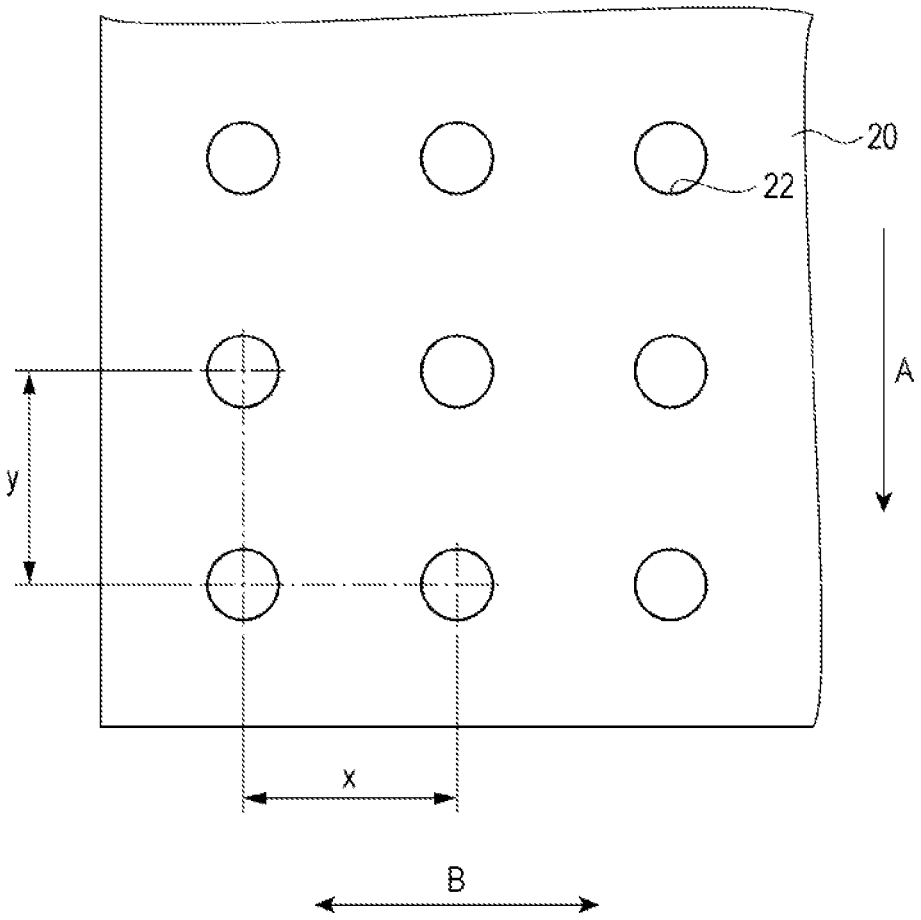
FIG. 4 is a schematic plan view illustrating the first member in the recording apparatus according to the first embodiment.

Furthermore, it is preferable that a plurality of second opening sections 22 be provided in the first member 20. FIG. 4 is a schematic plan view illustrating the first member 20 in the recording apparatus 1 according to the first embodiment. The plurality of second opening sections 22 are provided in the first member 20. Here, a circular opening is provided as the second opening section 22. It is possible to disperse a plurality of positions of the second opening sections 22 in the first member 20 by providing the plurality of second opening sections 22. Thus, unevenness in a condensation suppression effect with respect to the medium support section 6 is decreased and it is possible to effectively suppress the condensation of the vapor in the medium support section 6.

As described above, if the plurality of second opening sections 22 are provided, the opening ratio in the first member 20 is a ratio of total area of the plurality of second opening sections 22 to the area of the first member 20. Also in this case, if the plurality of second opening sections 22 are provided so that the opening ratio in the first member 20 is 10% or more and 60% or less, it is possible to effectively suppress the condensation of the vapor in the medium support section 6.

Furthermore, when providing the plurality of second opening sections 22 in the first member 20, if a distance between centroids of the second opening sections 22 in the transportation direction A is y and a distance between centroids of the second opening sections 22 in the intersecting direction B intersecting the transportation direction A is x, it is preferable that the plurality of second opening sections 22 are provided so as to satisfy 2×(area of one second opening section 22)≤x×y≤5×(area of one second opening section 22). Here, x×y corresponds to an area of a region that is formed by the centroids of four second opening sections 22. Furthermore, an area of one second opening section 22 is an area of an arbitrary one second opening section 22 in a case where the plurality of second opening sections 22 are provided.

The distance y between centroids of the second opening sections 22 in the transportation direction A and the distance x between centroids of the second opening sections 22 in the intersecting direction B are illustrated in FIG. 4. Here, the centroid of the second opening section 22 is a center of a planar shape when viewing the second opening section 22 in a plan view. If x×y is less than 2×(area of one second opening section 22), the distance between the second opening sections 22 is decreased. At this time, since the area of the non-opening section of the first member 20 is too small, the effect of the first member 20 cannot be sufficiently exerted. That is, it becomes similar to a state where the member for condensing the vapor is only the second member. Furthermore, if x×y is greater than 5×(area of one second opening section 22), the distance between the second opening sections 22 is increased. At this time, since the vapor flowing to the second member 24 is too small, the effect of the second member 24 cannot be sufficiently exerted. That is, it becomes similar to a state where the member for condensing the vapor is only the first member. On the contrary, according to configuration of 2×(area of one second opening section 22)≤x×y≤5×(area of one second opening section 22), it is possible to disperse the arrangement positions of the plurality of second opening sections 22 while appropriately maintaining the balance between some of the vapor being condensed in the first member 20 and some of the vapor passing through the first member 20. Thus, the unevenness in the condensation suppression effect with respect to the medium support section 6 is decreased while developing the synergistic effect due to the combination of the first member 20 and the second member 24. Therefore, it is possible to effectively suppress the condensation of the vapor in the medium support section 6.

Table 5 represents evaluation results that are obtained by evaluating whether or not the vapor evaporated from the ink recorded on the medium P is condensed in the medium support section 6 when the value of x×y is changed by fixing the value of y and changing the value of x. A case where the condensation does not visually occur in the medium support section 6 is OK and a case where the condensation occurs in the medium support section 6 is NG. Moreover, in Table 5, the area of the opening section is the area of an arbitrary one second opening section 22. As represented in Table 5, the evaluation result of OK was obtained in the range of 2×(area of one second opening section 22)≤x×y≤5×(area of one second opening section 22).

TABLE 5

| x (mm) | y (mm) | Area of Opening Section ($mm^2$) | 2 × Area of Opening Section | x × y | 5 × Area of Opening Section | Evaluation Result |
|---|---|---|---|---|---|---|
| 10 | 15 | 78.5 | 157 | 150 | 392.5 | NG |
| 15 | 15 | 78.5 | 157 | 225 | 392.5 | OK |
| 20 | 15 | 78.5 | 157 | 300 | 392.5 | OK |
| 25 | 15 | 78.5 | 157 | 375 | 392.5 | OK |
| 30 | 15 | 78.5 | 157 | 450 | 392.5 | NG |

As represented in Table 5, when the value of x was a value satisfying the relationship of 2×(area of one second opening section 22)≤x×y≤5×(area of one second opening section 22), the result of OK was obtained.

Table 6 represents evaluation results that are obtained by evaluating whether or not the vapor evaporated from the ink recorded on the medium P is condensed in the medium support section 6 when the value of x×y is changed by fixing the value of x and changing the value of y. A case where the condensation does not visually occur in the medium support section 6 is OK and a case where the condensation occurs in the medium support section 6 is NG. Moreover, in Table 6, the area of the opening section is the area of an arbitrary one second opening section 22. As represented in Table 6, the evaluation result of OK was obtained in the range of 2×(area of one second opening section 22)≤x×y≤5×(area of one second opening section 22).

TABLE 6

| x (mm) | y (mm) | Area of Opening Section ($mm^2$) | 2 × Area of Opening Section | x × y | 5 × Area of Opening Section | Evaluation Result |
|---|---|---|---|---|---|---|
| 15 | 10 | 78.5 | 157 | 150 | 392.5 | NG |
| 15 | 15 | 78.5 | 157 | 225 | 392.5 | OK |
| 15 | 20 | 78.5 | 157 | 300 | 392.5 | OK |
| 15 | 25 | 78.5 | 157 | 375 | 392.5 | OK |
| 15 | 30 | 78.5 | 157 | 450 | 392.5 | NG |

As represented in Table 6, when the value of y was a value satisfying the relationship of 2×(area of one second opening section 22)≤x×y≤5×(area of one second opening section 22), the result of OK was obtained.

Moreover, when performing the evacuations of Table 5 and Table 6, one of x and y was fixed and the other value was changed, but the values of x and y may be simultaneously changed or the area of the opening section may be changed. If x, y, and the area of one second opening section 22 are determined so as to satisfy the relationship of 2×(area of one second opening section 22)≤x×y≤5×(area of one second opening section 22), it is possible to obtain the same effect as the embodiment described above.

Furthermore, it is preferable that the first member 20 be disposed so that the distance L1 from the medium support section 6 is 2 mm or more and 20 mm or less. Here, if the distance L1 from the medium support section 6 is not constant, it is preferable that the first member 20 be disposed so that the distance L1 is 2 mm or more and 20 mm or less in any portion. If the distance L1 between the first member 20 and the medium support section 6 is 2 mm or more, it is possible to suppress liquid droplets being condensed in the first member 20 to be attached to the medium support section 6, and if the distance L1 between the first member 20 and the medium support section 6 is 20 mm or less, it is possible to suppress the condensation of the vapor in the medium support section 6 with high accuracy.

Table 7 represents evaluation results that are obtained by evaluating whether or not the vapor evaporated from the ink recorded on the medium P is condensed in the medium support section 6 when the distance L1 between the first member 20 and the medium support section 6 is changed. A case where the condensation does not visually occur in the medium support section 6 is OK and a case where the condensation occurs in the medium support section 6 is NG. Moreover, if the distance L1 between the first member 20 and the medium support section 6 is less than 2 mm, liquid droplets condensed in the first member 20 were attached to the medium support section 6.

TABLE 7

| Distance L1 (mm) | Evaluation Result |
|---|---|
| 2 | OK |
| 4 | OK |
| 6 | OK |
| 8 | OK |
| 10 | OK |

TABLE 7-continued

| Distance L1 (mm) | Evaluation Result |
|---|---|
| 12 | OK |
| 14 | OK |
| 16 | OK |
| 18 | OK |
| 20 | OK |
| 22 | NG |
| 24 | NG |
| 26 | NG |
| 28 | NG |
| 30 | NG |

As represented in Table 7, the result of OK was obtained when the distance L1 between the first member 20 and the medium support section 6 was 2 mm or more and 20 mm or less.

The shapes and the like of the first member 20 and the second member 24 are not specifically limited, but it is preferable that the temperature conductivity in the first member 20 and the second member 24 be higher than that in the medium support section 6. Therefore, it is possible to suppress the condensation of the vapor in the medium support section 6 with high accuracy. Furthermore, it is preferable that the thermal conductivity in the first member 20 and the second member 24 be higher than that in the medium support section 6. Therefore, it is easy to manufacture a condensation guiding structure aimed for.

Furthermore, it is preferable that the contact angle of the first member 20 and the second member 24 with the liquid droplets generated by condensation of the vapor be smaller than that of the medium support section 6. Therefore, it is possible to suppress the condensation of the vapor in the medium support section 6 with high accuracy.

It is preferable that at least a part of the first member 20 and the second member 24 be made of aluminum. Thus, it is possible to make a sturdy configuration because aluminum is inexpensive and lightweight, and the temperature conductivity and the thermal conductivity thereof are high, the contact angle of the first member and the second member with the liquid droplets generated by condensing the vapor is small and aluminum is to be wet easily. Thus, the vapor flows to the first member 20 and the second member 24 before the vapor is condensed in the medium support section 6, it is possible to condense the vapor in the first member 20 and the second member 24, and it is possible to suppress the condensation of the vapor in the medium support section 6 with high accuracy.

As described above, according to the recording apparatus 1 of the embodiment, in the recording apparatus including the heater for drying the liquid that is recorded on the medium by ejecting the liquid on the medium, it is possible to suppress the condensation of the vapor evaporated from the liquid by the heater in the medium support section.

Moreover, the invention is not limited to the embodiment described above and it is possible to add various changes, modifications, and the like to the embodiment described above. The modification examples are described below.

Modification Example 1

Figure 5A:
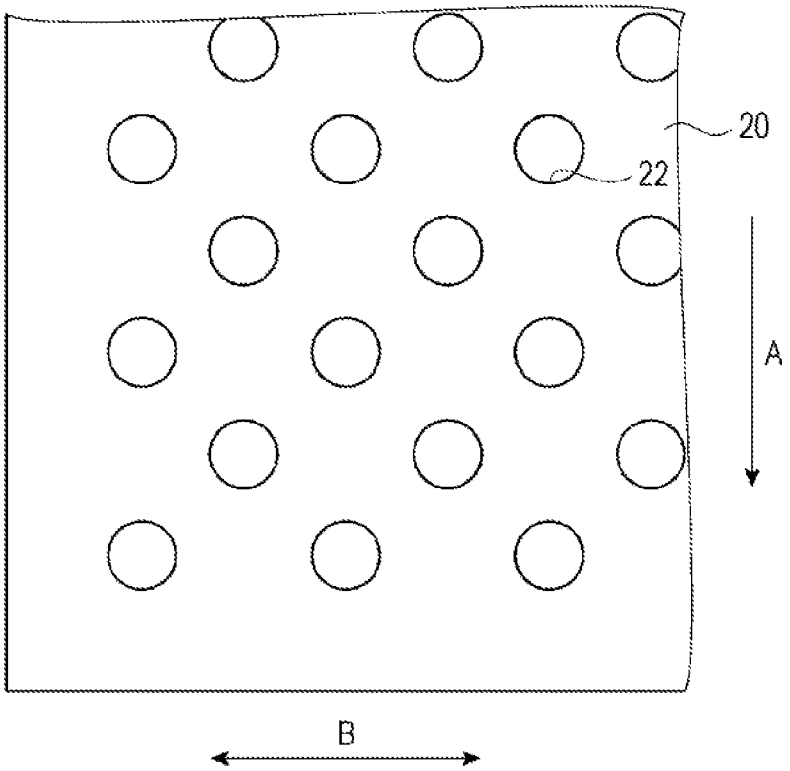
FIGS. 5A and 5B are schematic plan views illustrating a first member in a recording apparatus according to Modification Examples.

FIG. 5A is a schematic plan view illustrating a first member 20 in a recording apparatus 1 according to Modification Example 1. The Modification Example 1 has the same configuration as that of the first embodiment other than the first member 20. A plurality of second opening sections 22 are disposed in a zigzag shape in the first member 20. In other words, a plurality of columns of the second opening sections 22 arranged in a direction of the transportation direction A are disposed in a direction of the intersecting direction B. The Nth column of the second opening sections 22 (N is an integer of 1 or more) and the (N+1)th column of the second opening sections 22 are disposed so that the positions of the second opening sections 22 in the transportation direction A are different from each other. Even if the plurality of second opening sections 22 are disposed as described above, it is possible to disperse the second opening sections 22 in a plurality of positions. Thus, the unevenness in the condensation suppression effect with respect to the medium support section 6 is decreased so that it is possible to effectively suppress the condensation of the vapor in the medium support section 6.

As described above, if the plurality of second opening sections 22 are provided, the opening ratio in the first member 20 is a ratio of total area of the plurality of second opening sections 22 to the area of the first member 20. Also in this case, if the plurality of second opening sections 22 are provided so that the opening ratio in the first member 20 is 10% or more and 60% or less, it is possible to effectively suppress the condensation of the vapor in the medium support section 6.

Modification Example 2

Figure 5B:
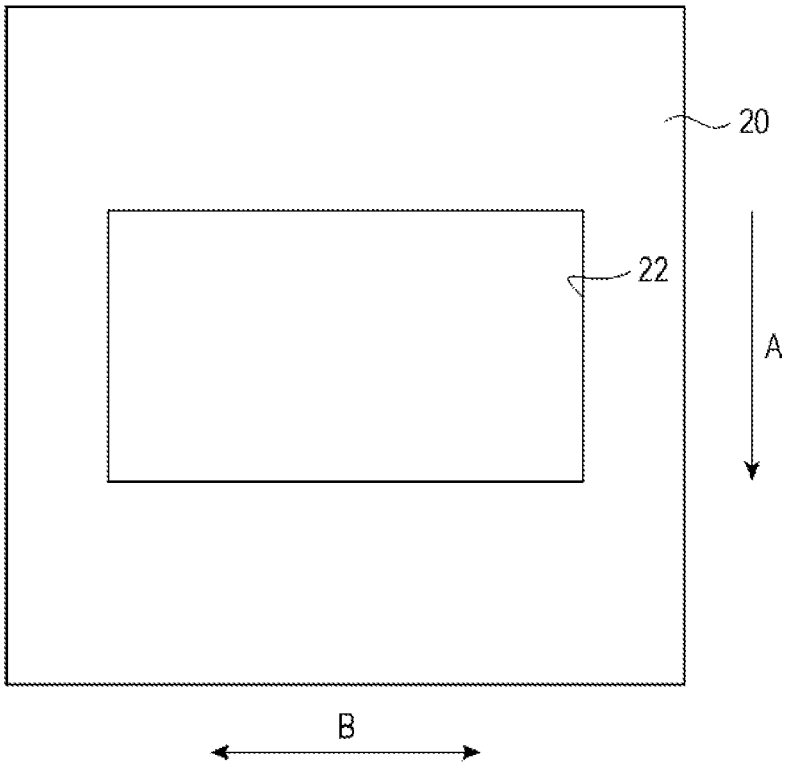

FIG. 5B is a schematic plan view illustrating a first member 20 in a recording apparatus 1 according to Modification Example 2. Modification Example 2 has the same configuration as that of the first embodiment other than the first member 20. One second opening section 22 is provided in the first member 20. As described above, the second opening section 22 may be singular.

At this time, it is preferable that the opening ratio in the first member 20 be 10% or more and 60% or less. That is, if one second opening section 22 is provided so that the area ratio of the second opening section 22 to the area of the first member 20 is 10% or more and 60% or less, it is possible to effectively suppress the condensation of the vapor in the medium support section 6. If the second opening section 22 is singular, it is possible to separate the medium support section 6 into a high region and a low region for the condensation suppression effect. Furthermore, it is possible to have a simple configuration compared to a case where the plurality of second opening sections 22 are provided and to suppress costs and a time for machining thereof.

Other Modification Examples

The head 4 may have a configuration of a serial head forming (recording) an image on the medium P by ejecting the liquid while moving in the intersecting direction B and the head 4 may have a configuration of a line head forming (recording) an image on the medium P by ejecting the liquid without moving in the intersecting direction B. In the head 4 that is the line head, it is preferable that a plurality of nozzles be provided in the intersecting direction B. In this case, the line head may be configured by connecting the plurality of nozzles and the line head may be configured of one long head. If the head 4 is formed with the configuration of the line head, the amount of the liquid ejected at one time is larger than that of the case where the head 4 is formed with the configuration of the serial head. Therefore, since the amount of the generated vapor is also large, a configuration including a plurality of members for condensing the vapor is particularly useful.

Furthermore, as the liquid capable of being ejected from the head 4, the ink is exemplified, but other liquid such as a pretreatment agent or a post-treatment agent may be used. Even when using other liquid, it is possible to obtain the same effect as the embodiment.

Furthermore, as the member for condensing the vapor, two members of the first member 20 and the second member 24 are provided, but three or more members for condensing the vapor may be provided. In this case, it is preferable that a plurality of first members 20 provided with the second opening sections 22 be provided between the medium support section 6 and the second member 24. It is possible to increase the condensation suppression effect of the vapor in the medium support section 6 by increasing the number of the members for condensing the vapor.

Furthermore, as the second opening section 22, the circular opening is provided, but as the second opening section 22, an opening having another shape may be provided. For example, a polygonal opening or an oval opening may be provided. Furthermore, if the plurality of second opening sections 22 are provided, all of the second opening sections 22 may not be the same shape and, for example, the circular openings and the polygonal openings may coexist. Furthermore, all of the second opening sections 22 may not be the same size and the second opening sections 22 having different sizes may coexist.

Furthermore, in the recording apparatus 1, the auxiliary heater 5 may not be provided. If drying of the liquid is sufficiently performed by heating by the heater 7, the auxiliary heater 5 may not be provided. If the auxiliary heater 5 is not provided, it is possible to configure the recording apparatus 1 more simply and to suppress costs and a time for machining thereof.

Moreover, the invention may be formed by combining appropriately the embodiment or the modification examples described above.

The configuration of the invention described in the embodiment and the modification examples described above are particularly useful in a recording apparatus capable of recording using an aqueous ink containing a water-soluble organic solvent. In the recording apparatus using such ink, the water-soluble organic solvent is included as the vapor and since the water-soluble organic solvent is not easily volatilized if the vapor is condensed in the medium support section 6, the medium may be wet with the water-soluble organic solvent. However, the recording apparatus to which the configuration of the invention is applied is not limited to such a recording apparatus.

What is claimed is:

1. A recording apparatus comprising:

a head that is configured to eject liquid on a medium;

a heater that dries the liquid ejected on the medium;

a medium support section that is provided with a first opening section through which vapor which is evaporated from the liquid ejected on the medium passes;

a first member that is provided with a second opening section through which the vapor passing through the first opening section passes and allows at least some of the vapor to be condensed, wherein the first member is disposed at a distance L1 from the medium support section such that the first member and the support section do not contact so as to define an empty space comprising an air gap between the first member and the medium support section; and a second member that allows the vapor passing through the second opening section to be condensed.

2. The recording apparatus according to claim 1, wherein a ratio of total area of the second opening section to an area of the first member is 10% or more and 60% or less.

3. The recording apparatus according to claim 1, wherein the first member is provided with a plurality of second opening sections.

4. The recording apparatus according to claim 3, wherein if a distance between centroids of the second opening sections in a transportation direction in which the medium is transported is y and a distance between centroids of the second opening sections in an intersecting direction intersecting the transportation direction is x, the plurality of second opening sections are provided so as to satisfy $2\times$(area of one second opening section)$\leq x\times y\leq 5\times$(area of one second opening section).

5. The recording apparatus according to claim 1, wherein the distance L1 is 2 mm or more or 20 mm or less.

* * * * *